US006189619B1

(12) United States Patent
Wyatt et al.

(10) Patent No.: US 6,189,619 B1
(45) Date of Patent: Feb. 20, 2001

(54) SLIDING SLEEVE ASSEMBLY FOR SUBSURFACE FLOW CONTROL

(76) Inventors: Mark L. Wyatt, 26 Cinnamon Teal Pl., The Woodlands, TX (US) 77382; Brad N. Huber, 521 Cavaness Dr., Houma, LA (US) 70364

( * ) Notice: Under 35 U.S.C. 154(b), the term of this patent shall be extended for 0 days.

(21) Appl. No.: 09/327,108

(22) Filed: Jun. 7, 1999

(51) Int. Cl.[7] ..... E21B 34/14
(52) U.S. Cl. ..... 166/332.1; 166/332.4
(58) Field of Search ..... 166/332.1, 332.4, 166/334.1, 386, 381

(56) References Cited

U.S. PATENT DOCUMENTS 4,347,900 * 9/1982 Barrington ..... 166/380
5,263,683 11/1993 Wong ..... 251/145
5,823,265 * 10/1998 Crow et al. ..... 166/373

* cited by examiner

*Primary Examiner*—David Bagnell
*Assistant Examiner*—Jennifer M Hawkins
(74) *Attorney, Agent, or Firm*—Thomason, Moser & Patterson L.L.P.

(57) ABSTRACT

Two sliding sleeves are carried in a tubular pipe assembly for controlling the opening and closing of flow passages extending through the pipe wall. The pipe assembly is placed at the lower end of a tubing string disposed in a well to regulate the flow of fluid from the string into a subsurface well formation. The first sleeve extends between upper and lower seals disposed above and below the flow passage to close the flow passages to flow. A shifting tool operated from the well surface moves the sleeve axially down through the pipe assembly to open the flow passages, leaving the upper seal exposed. The shifting tool then moves the second sleeve axially down through the pipe to cover the exposed seal. Fluid pumped through the pipe exits freely through the flow passages without first having to flow through radial flow passages in the sliding sleeve to prevent erosion of the flow passages and the sleeve structure. The two sleeve sections protect the upper and lower seals and sealing surfaces from erosion as fluid is pumped.

10 Claims, 2 Drawing Sheets

SLIDING SLEEVE ASSEMBLY FOR SUBSURFACE FLOW CONTROL

BACKGROUND OF THE INVENTION

1. Field of the Invention

The present invention relates generally to means for remotely opening and closing flow passages through a tubular body. More particularly, the present invention relates to means for remotely opening a subsurface flow passage in a pipe string contained within a well bore to inject fracturing slurries into the well formation.

2. Description of Prior Art Setting

After a well is drilled, it is sometimes necessary to inject pressurized fluid slurries into the well bore to fracture and prop open the resulting cracks formed in the formation. The slurry typically is made up of sand particles entrained in a supporting well treating fluid. The particulate matter lodges in the formation cracks created by the high pressure pumping to keep the cracks open after the pumping pressure is reduced. Fracturing and propping open of the formation permits an increase in the flow of the underground petroleum fluids to the well bore. The solids in the high pressure, rapidly flowing fracturing fluid can quickly erode the pipe and accessories used to pump the fluid into the formation.

Sliding sleeves are commonly employed in pipe strings to open and close subsurface access openings in the pipe as required to inject fluid into the formation or to produce fluid from the formation. An example of a prior art sliding sleeve system is shown in U.S. Pat. No. 5,263,683. The patent discloses an internal sliding sleeve within a ported pipe section. Shifting the sleeve axially so that openings in the sleeve align with openings in the pipe establishes a flow path through the wall of the pipe section. The seals above and below the pipe ports remain covered and protected by the sliding sleeve in both the open and closed positions. In this prior art device, the flow path for fluids entering or leaving the pipe extends through the pipe ports as well as the sleeve openings. The surface contours of the pipe ports and the sliding sleeve openings, as well as the annular space between the sleeve and the internal pipe wall, induce turbulent flow as the fluids traverse the flow path. The turbulent flow, in turn, when combined with entrained abrasives such as sand can quickly wear away and otherwise damage the pipe and sliding sleeve assembly.

SUMMARY OF THE INVENTION

Two separate sleeves are employed in a sliding sleeve assembly to control opening and closing of a subsurface pipe opening. In the open position, the sliding sleeves are physically moved away from the pipe openings so that no turbulent flow is induced by their proximity to the pipe opening. Fluid is free to flow directly from the pipe through the pipe opening without first traveling through openings in the wall of a sliding sleeve. The seal at the lower axial end of the pipe opening is protected by one of the sleeves while the seal at the upper axial end of the pipe opening is protected by the second sleeve. The sealing surfaces of the sleeves are also protected from abrasion by the removal of the sleeves from the turbulent flow at the pipe openings.

From the foregoing it will be appreciated that a primary object of the present invention is to provide a sliding sleeve assembly for a subsurface opening in a pipe string that reduces the erosive effects of fluid flowing through the subsurface opening while simultaneously protecting the seals and sealing surfaces of the assembly.

The foregoing features, objectives, and advantages of the present invention will be more fully understood and appreciated by reference to the following drawings, specification, and claims.

DESCRIPTION OF THE ILLUSTRATED EMBODIMENTS

Figure 1:
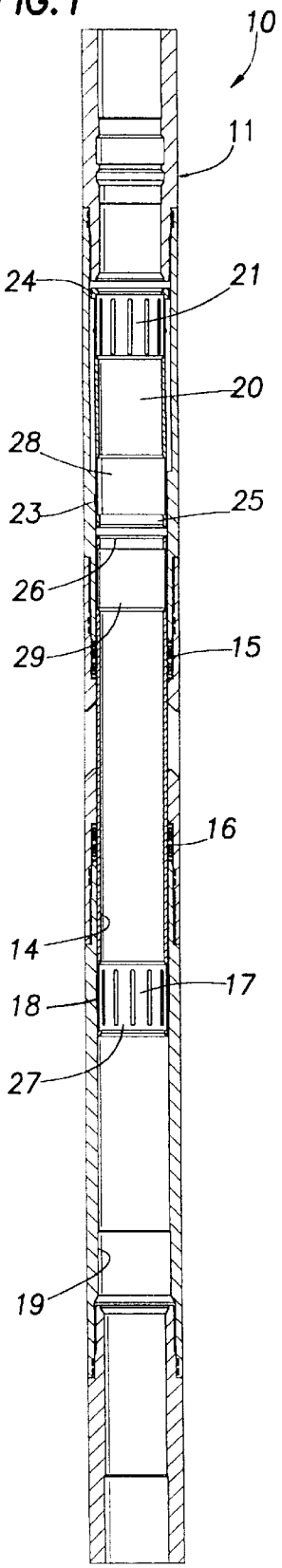
FIG. 1 is a vertical cross-sectional view of the sliding sleeve assembly of the present invention illustrated in its closed position.

The sliding sleeve assembly of the present invention is indicated generally at 10 in FIG. 1. The assembly 10 is adapted to be employed as part of a tubing string (not illustrated) in a well, extending between a subsurface formation and the well surface. As employed in the present invention, the assembly 10 is used to inject fluid slurries from the tubing string into the subsurface formation to fracture and prop open the formation surrounding the well bore. After the formation has been fractured, the assembly 10 is employed as part of the tubing string to convey well fluids back to the well surface.

Figure 3:
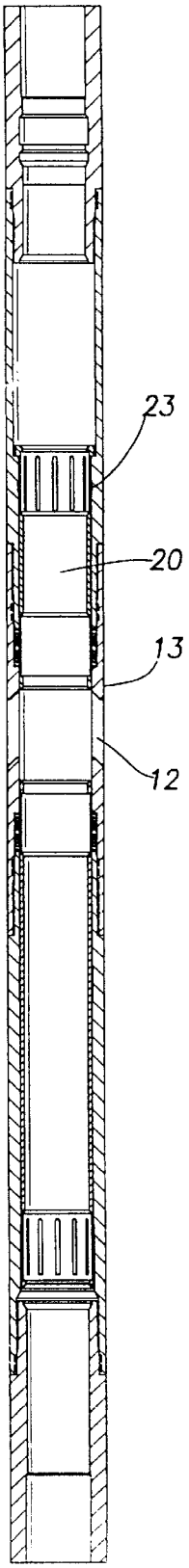
FIG. 3 is a vertical cross-sectional view of the sliding sleeve assembly of the present invention in its fully open position.

The fracturing fluid used to treat the formation is pumped through the tubing string and through a top 11 of the assembly 10. As best illustrated in FIG. 3, fluid entering the assembly 10 at the top 11 exits the assembly through circumferentially spaced, axially and radially extending slots 12 opening through the assembly wall 13. During the fracturing process, the tubing below the assembly 10 is plugged (not illustrated) to force the fracturing fluid to flow from the assembly through the radial slots 12. After the fracturing procedure has been completed, the radial slots 12 are re-closed, as illustrated in FIG. 1, and petroleum fluids from the surrounding well formation are introduced into the associated tubing string, either above or below the assembly 10, where the fluids are conducted to the well surface.

With reference to FIG. 1, the radial slots 12 are closed by a lower sliding sleeve 14 extending between upper packing seals 15 and lower packing seals 16 carried internally of the assembly wall 13 adjacent either axial side of the radial slots 12. The packing seals 15 and 16 are conventional and may be constructed of any suitable material and in any suitable form, including the chevron packing seal arrangement described in detail in the previously mentioned U.S. Pat. No. 5,263,683. The sleeve 14 is axially movable through the assembly 10 to the position illustrated in FIG. 3 to open the radial slots 12.

Figure 1A:
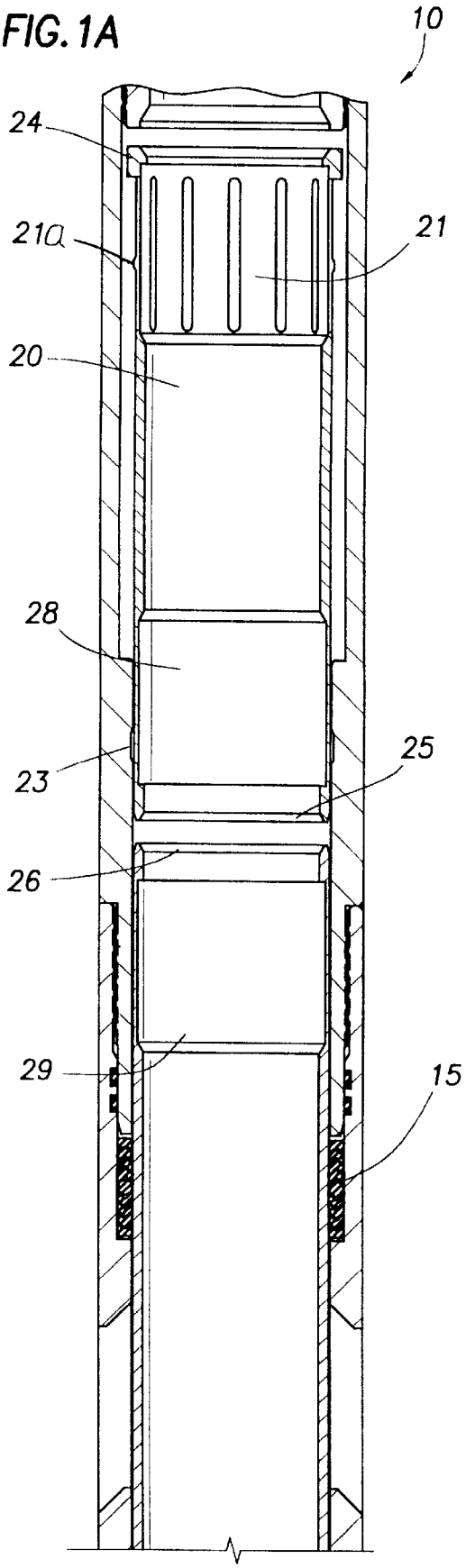
FIGS. 1A and 1B are enlarged, vertical cross-sectional views, in two sections, of the sliding sleeve assembly of the present invention.
Figure 1B:
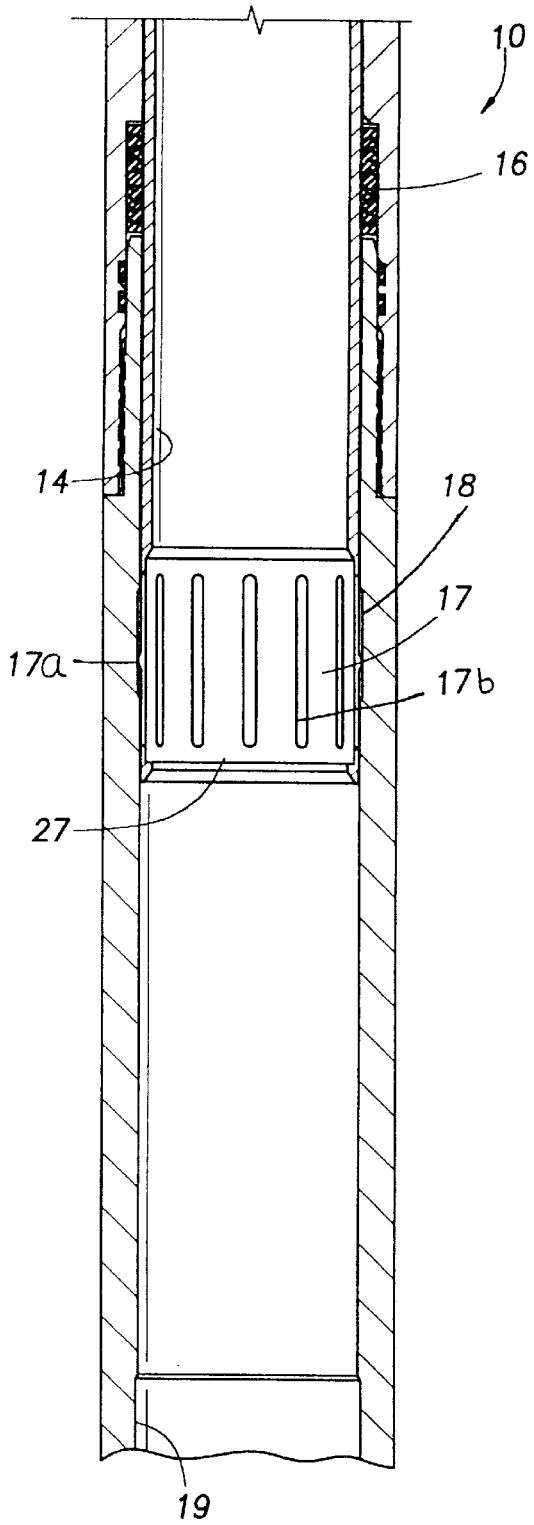

With reference to FIG. 1B, the sleeve 14 is retained in the closed position illustrated in FIG. 1 by a retention structure formed by radial collet projections 17*a* on collets 17. The collets 17 are axially extending, circumferentially spaced wall strips formed between axial slots 17*b* cut in the wall of the sleeve 14.

The projections 17*a* bias the metal wall strips 17 radially inwardly when the projections are engaged with the internal surface of the assembly wall 13. Once the projections 17*a* register with an annular recessed collet groove 18 formed within the assembly wall 13, the wall strips spring back to their normal diameter. Engagement of the projections 17*a* within the groove 18 resists axial movement of the sleeve. Shifting of the sleeve requires that the collet wall strips be radially compressed as the projections 17*a* move out of the groove 18 and back into the non-recessed area within the assembly wall 13. A second, lower collet groove 19 cooperates with the projections 17*a* and the collets 17 in a similar fashion to resist axial movement of the sleeve 14 from its lower opened position illustrated in FIG. 3.

With reference to FIG. 1A, the assembly 10 is provided with a second sliding sleeve 20 that is used to protect the upper packing seals 15. A second retention structure is provided by radial projections 21*a* on collets 21 on the sleeve 20 that engage a lower collet groove 23 to hold the sleeve 20 in the open position illustrated in FIG. 3. The collets 21 operate in a manner similar to that described with reference to the collets 17.

The sleeves 14 and 20 are provided with a shifting tool engagement structure including annular, internal, square-shouldered lips 24, 25, 26, and 27 adjacent the ends of the sleeves and internally recessed areas 28 and 29 formed intermediate the collets and the ends of the sleeves. The shifting tool engagement structure of the assembly 10 is conventional and is not, per se, a part of the present invention.

In operation, the sliding sleeves 14 and 20 are shifted axially between their open and closed positions by a shifting tool (not illustrated) that is lowered from the well surface through the tubing string attached to the assembly 10 and into engagement with the shifting tool engagement structure. The shifting tool and the engagement of the tool with the sleeves 14 and 20 are conventional.

Figure 2:
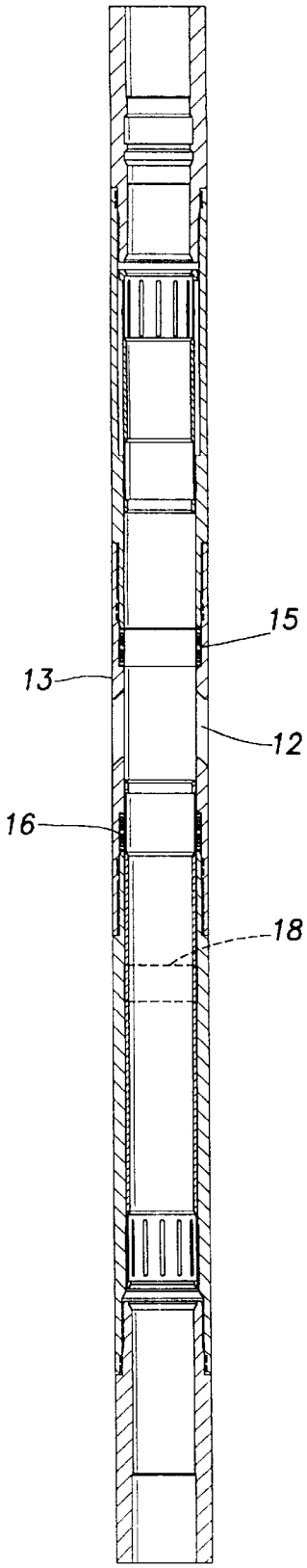
FIG. 2 is a vertical cross-sectional view illustrating the sliding sleeve assembly of the present invention in its intermediate position.

To open the assembly 10, the shifting tool engages the lower sleeve and shifts it from the position illustrated in FIG. 1 to the position illustrated in FIG. 2. During this procedure, the collets 17 release from the collet groove 18, travel downwardly through the assembly wall 13, and spring into the collet groove 19 where they hold the sleeve in the open position following removal of the shifting tool. In this position, the radial ports 12 are open permitting communication through the assembly wall 13; however, the seals 15 are unprotected from the fluids within the assembly 10. The shifting tool then shifts the upper sleeve 20 from the position illustrated in FIG. 2 to the position illustrated in FIG. 3. During this part of the procedure, the collets 21 of the sleeve 20 release from the collet groove 23 and spring into the collet groove 22 to hold the sleeve in open position following the removal of the shifting tool.

When the assembly 10 is in the position illustrated in FIG. 3, fluids entering the assembly at its upper end 11 flow freely from the assembly through the radial flow slots 12 into the surrounding formation without first having to pass through radial openings formed in the sliding sleeves. The complete removal of any sleeve structure from the immediate area of the flow slots reduces localized turbulence in the exiting fluid to minimize erosion of the assembly components. In the illustrated open position of the assembly in FIG. 3, the upper sleeve 20 overlies and seals with the upper packing seal 15 to prevent contact of the seal with the fluid being pumped through the assembly 10. The sliding sleeve 14 likewise protects the lower packing seal 16 from exposure to the flowing fracturing fluid. The external sealing surfaces of the two sliding sleeves are also protected from erosion by the flowing fluid.

After the formation has been fractured, the shifting tool is run to reposition the sleeves 14 and 20 into the closed position illustrated in FIG. 1. The shifting tool may be run on wire line or may be run on a coiled tubing string or may be hydraulically actuated or otherwise operated to provide the desired axial movement of the sliding sleeves between their open and closed positions. It will also be appreciated that the shifting of the sleeves may be accomplished in a single trip of the shifting tool or may be performed in separate trips.

While the invention has been described in detail with respect to a preferred embodiment thereof, it will be understood and appreciated that various modifications in the described operation and construction of the assembly 10 may be made without departing from the spirit and scope of the invention. For example, the axial positions of the first and second sleeves may be reversed such that an upward axial movement of one of the sleeves opens the radial ports and exposes the lower seal and an upward movement of the second sleeve moves the second sleeve over the exposed lower seal. It will also be understood that while the packing seals 15 and 16 are illustrated as being carried in grooves in the internal wall of the assembly 10, seals may be carried by the sleeves to achieve the desired opening and closing of the flow path and the protection of the sealing surfaces of the internal pipe wall against which the seals engage while closing the flow path. Similarly, while a closed collet comprising axially extending collet strips and annular collet grooves have been described for temporarily retaining the sleeves in desired axial positions, other mechanisms, such as an open collet comprising collet fingers or other devices, may be employed to achieve this end. Additionally, while the packing seals have been described as chevron seals, other suitable sealing structure may be employed. It will also be understood that the radial openings through the assembly 10 need not necessarily be axial slots but may be circular ports or other opening configurations as desired for a particular application.

What is claimed is:

1. An assembly for opening and closing a flow passage in a tubular wall of an axially extending conduit, comprising:

a flow passage extending radially and axially through said wall for communicating fluid across said wall;

first and second axially spaced annular seals carried in said tubular wall adjacent each axial end of said passage;

first and second axially movable sleeves disposed within said conduit, said first sleeve being movable axially relative to said second sleeve and engageable with said first and second seals for closing said passage to flow and disengageable with said first seal for opening said passage to flow; and said second sleeve being movable into engagement with said first seal for protecting said first seal from flow.

2. The assembly as defined in claim 1, further comprising:

a first releasable retention structure on said first sleeve for retaining said first sleeve at an axial position closing said flow passage or at an axial position opening said flow passage; and a second releasable retention structure on said second sleeve for retaining said second sleeve at an axial position engaged with said first seal or at an axial position out of engagement with said first seal.

3. The assembly as defined in claim 2 wherein said first and second releasable retention structures comprise circumferentially spaced, axially extending slots forming wall strips resiliently biased toward said wall of said conduit.

4. The assembly as defined in claim 3 wherein said flow passage comprises circumferentially spaced, axially extending slots extending through said wall.

5. The assembly as defined in claim 4 wherein said first and second seals comprise chevron packing seals.

6. The assembly as defined in claim 5, further including engagement structure on said first and second sleeves for releasable shifting engagement whereby said sleeves may be shifted between said closed and open positions from a remote location.

7. The assembly as defined in claim 6 wherein said shifting tool engagement structure includes square-shouldered internal lips within said first and second sleeves.

8. The assembly as defined in claim 1 wherein said flow passage comprises circumferentially spaced, axially extending slots extending through said wall.

9. The assembly as defined in claim 1, further including engagement structure on said first and second sleeves for releasable shifting engagement whereby said sleeves may be shifted between said closed and open positions from a remote location.

10. The assembly as defined in claim 1 wherein said first and second seals comprise chevron packing seals.

* * * * *